US009039585B2

(12) United States Patent
Derrick

(10) Patent No.: US 9,039,585 B2
(45) Date of Patent: May 26, 2015

(54) EXERCISE MACHINE

(71) Applicant: John D. Derrick, Transfer, PA (US)

(72) Inventor: John D. Derrick, Transfer, PA (US)

( * ) Notice: Subject to any disclaimer, the term of this patent is extended or adjusted under 35 U.S.C. 154(b) by 49 days.

(21) Appl. No.: 13/839,304

(22) Filed: Mar. 15, 2013

(65) Prior Publication Data

US 2013/0210588 A1 Aug. 15, 2013

Related U.S. Application Data

(63) Continuation-in-part of application No. 13/019,361, filed on Feb. 2, 2011, now Pat. No. 8,540,610.

(60) Provisional application No. 61/300,893, filed on Feb. 3, 2010.

(51) Int. Cl.

| | |
|---|---|
| ***A63B 21/00*** | (2006.01) |
| ***A63B 21/068*** | (2006.01) |
| ***A63B 26/00*** | (2006.01) |
| ***A63B 21/06*** | (2006.01) |
| ***A63B 21/062*** | (2006.01) |
| ***A63B 21/075*** | (2006.01) |
| ***A63B 21/22*** | (2006.01) |
| ***A63B 23/02*** | (2006.01) |

(52) U.S. Cl.

CPC ..... *A63B 21/068* (2013.01); *A63B 26/00* (2013.01); *A63B 21/00181* (2013.01); *A63B 26/003* (2013.01); *A63B 21/0615* (2013.01); *A63B 21/062* (2013.01); *A63B 21/075* (2013.01); *A63B 21/1426* (2013.01); *A63B 21/1461* (2013.01); *A63B 21/1465* (2013.01); *A63B 21/1469* (2013.01); *A63B 21/1492* (2013.01); *A63B 21/1496* (2013.01); *A63B 21/153* (2013.01); *A63B 21/156* (2013.01); *A63B 21/22* (2013.01); *A63B 23/0233* (2013.01); *A63B 23/0238* (2013.01); *A63B 2208/0261* (2013.01); *A63B 21/00072* (2013.01)

(58) Field of Classification Search

USPC ..... 482/96, 95, 72, 73, 62, 57, 51

See application file for complete search history.

(56) References Cited

U.S. PATENT DOCUMENTS

| | | | | |
|---|---|---|---|---|
| 5,322,489 | A * | 6/1994 | Webb et al. | 482/38 |
| 5,372,556 | A | 12/1994 | Ropp | |
| 5,676,626 | A * | 10/1997 | Huang | 482/96 |
| 6,551,226 | B1 | 4/2003 | Webber et al. | |
| 7,081,073 | B1 | 7/2006 | Smith | |
| 7,326,153 | B2 | 2/2008 | Bond | |
| 7,452,311 | B2 * | 11/2008 | Barnes et al. | 482/96 |
| 7,481,750 | B2 | 1/2009 | Fishel | |
| 2011/0190104 | A1 | 8/2011 | Derrick | |

FOREIGN PATENT DOCUMENTS

| | | |
|---|---|---|
| GB | 2186806 A | 8/1987 |

* cited by examiner

*Primary Examiner* — Jerome W Donnelly
(74) *Attorney, Agent, or Firm* — The Webb Law Firm

(57) ABSTRACT

An exercise machine includes a frame, a pivotable body support assembly, a lifting mechanism in parallel linear engagement with the frame, and a counter balance assembly connected to the body support assembly, wherein the body support assembly is pivotable from a downward position to a top position. The lifting mechanism includes a foot plate, an ankle pad, and a foot pad. The lifting mechanism also includes a lifting assist mechanism, such as a spring or gas shock. The counter balance assembly partially balances a body weight of a user as the body support assembly is pivoted from the downward position to the top position. A method of using an exercise machine includes stepping onto the foot plate and securing the back of a user's foot against the ankle pad, releasing the lift assist mechanism, and bringing the foot plate to the toe pad.

17 Claims, 15 Drawing Sheets

EXERCISE MACHINE

CROSS REFERENCE TO RELATED APPLICATIONS

This application is a continuation-in-part of U.S. application Ser. No. 13/019,361, filed Feb. 2, 2011, which claims priority to United States Provisional Patent Application No. 61/300,893, filed Feb. 3, 2010, the entire content of which is incorporated herein by reference.

BACKGROUND OF THE INVENTION

1. Field of the Invention

The present invention relates to compound exercises and exercise machines, and, in particular, to compound opposite origin exercises and machines therefor.

2. Description of Related Art

An opposite origin exercise is defined as an exercise that works the same muscles as a normal exercise, but does so from an opposite point of origin or insertion. Many exercises can be categorized as opposite origin exercises, and many involve body weight resistance. For example, an opposite origin exercise for a lat pull down exercise using a lat cable machine is a wide grip pull-up. There, an individual will pull his or her body up toward a pull-up bar, as opposed to pulling the weight down toward his or her chest while using a lat cable machine with body weight providing the resistance. Many times, individuals are incapable of performing these exercises because their muscles are not developed enough in order to overcome the resistance provided by their own body weight. Therefore, various machines have been developed to assist users by offsetting user body weight, such as pull-up machines, wherein users kneel on a platform movable in the vertical direction, which is connected to a weight stack via a cable and pulley system. One opposite origin exercise is a reverse leg curl. Normally, while performing a standard standing one leg curl, an individual will move his or her lower legs at the knees against weight resistance toward the gluteus muscle. This exercise works the gluteus and hamstring. In a reverse leg curl, the movement is reversed, wherein the individual will move the upper two-thirds of the body toward the feet and lower legs by bending at the knees, thereby using body weight as resistance. However, this exercise can be particularly difficult to perform, especially in individuals with underdeveloped gluteus muscles and hamstrings. These exercises can also present difficulties if the user has trouble getting into a proper starting position to perform these exercises. Therefore, a need exists for a machine that can be easily entered by a user and assist a user in performing a reverse leg curl by counter balancing the user's body weight.

SUMMARY OF THE INVENTION

An exercise machine may include a frame, a body support assembly in pivotable engagement with the frame, and a lifting mechanism in linear engagement essentially parallel with the frame and rotatable about a hinge. The counter balance assembly is connected to the body support assembly, wherein, in operation, the body support assembly is pivotable from a downward position to a top position, and the counter balance assembly partially offsets a body weight of a user in a prone position against the body support assembly as the body support assembly is pivoted from the downward position to the top position.

The lifting mechanism may include a foot plate with an ankle pad, a lifting assist mechanism, and a foot pad, wherein releasing energy from the lifting assist mechanism provides an upward force and brings the foot plate and foot pad together.

The exercise machine may also include a standing plate in pivotable engagement with the frame and a support member in pivotable engagement with the frame. In this arrangement, the support member pivots toward the standing plate and supports the weight of the standing plate.

The exercise machine may also include a counter balance assembly. The counter balance assembly includes a reaction arm extending from a rear portion of the body support assembly and pivotable about the frame. The reaction arm includes a weight bearing end opposite the body support assembly. When the body support assembly is in the downward position, the weight bearing end is in a raised position providing a counter balance to the user's body weight.

The exercise machine can also have a weight bearing end adapted to receive weights directly thereon.

The exercise machine counter balance assembly can also have a cable and pulley system having a first pulley, a second pulley, a weight stack, and a cable running from the weight stack over the first pulley, under the second pulley, and to the weight bearing end of the reaction arm, wherein, when the body support assembly is in the top position, the weight stack is in a lowered position, and, wherein when the body support assembly is in the downward position, the reaction arm lifts the weight stack to a raised position providing a counter balance to the user's body weight.

The exercise machine can also have an adjustment wheel which allows for the weight bearing end to be angularly adjustable with respect to the reaction arm between a plurality of angular positions.

The exercise machine can also have a body support assembly which includes a chest pad assembly. The chest pad assembly includes a chest pad and a chest pad frame. The chest pad frame is adjustable with the chest pad such that the chest pad is in slideable engagement with the chest pad frame and can be positioned at varying distances from the chest pad frame.

A method of performing an exercise, which may include positioning a user's feet on a foot plate and securing the user's ankle against an ankle pad, releasing a lever, moving the foot plate towards a toe pad, and rotating the foot plate, toe pad, and ankle pad about a hinge.

The method can also include orienting a user's body prone against a body support assembly, where the body support assembly is pivotally engaged with an exercise machine frame, counter balancing a user's body weight via a counter balance assembly attached to the body support assembly of the exercise machine frame, and moving the user's body from a downward position to a top position by pivoting the body support assembly from a downward position to a top position about the exercise machine frame via the user's knees. Then, moving the user's body from the top position to the downward position by pivoting the body support assembly from the top position to the downward position about the exercise machine frame via the user's knees.

The step of counterbalancing the user's body can include the step of offsetting the user's body weight by adding weight resistance to a weight bearing end of a reaction arm extending away from the body support assembly, the weight bearing end being opposite the body support assembly.

A method of performing an exercise, which can include the steps of lowering a body support assembly to a position wherein a user is able to engage the body support assembly with an ankle and the user exerts force upon the body support member using the user's hamstring muscle.

BRIEF DESCRIPTION OF THE DRAWINGS

The invention may be more completely understood in consideration of the following drawing figures and description wherein like reference numbers identify like parts throughout.

DESCRIPTION OF THE PREFERRED EMBODIMENTS

Figure 1:
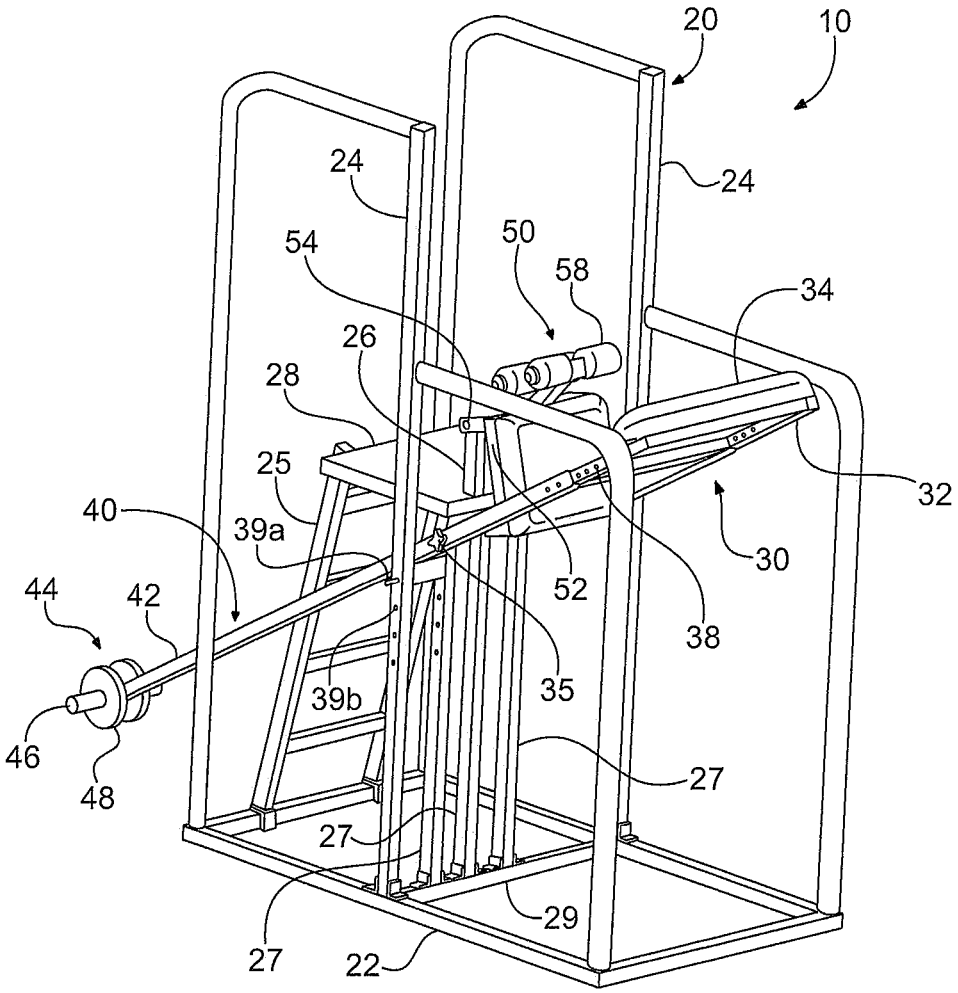
FIG. 1 is a perspective view of an embodiment of an exercise machine.

For purposes of the description hereinafter, spatial orientation terms, if used, shall relate to the referenced embodiment as it is oriented in the accompanying drawing figures, or otherwise described in the following detailed description. However, it is to be understood that the embodiments described hereinafter may assume many alternative variations and embodiments and that the specific embodiments illustrated in the accompanying drawing figures and described herein are simply exemplary and should not be considered as limiting.

Referring first to FIGS. 1-4, an exercise machine 10 may generally include a frame 20, a body support assembly 30, and a counter balance assembly 40. The body support assembly 30 and counter balance assembly 40 may be pivotable with respect to the frame 20 at a pivot point 35.

Figure 6A:
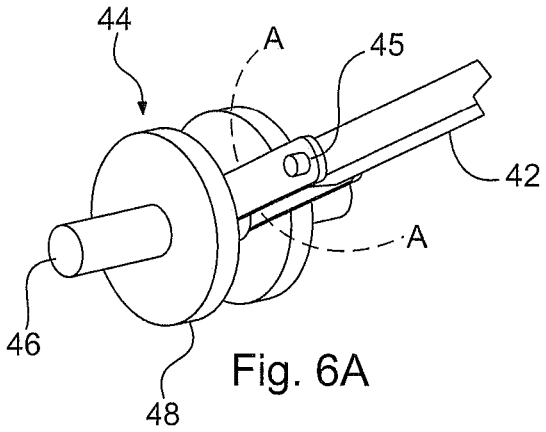
FIG. 6A shows an embodiment of a weight bearing end of a counter balance assembly of the exercise machine of FIG. 1.
Figure 6B:
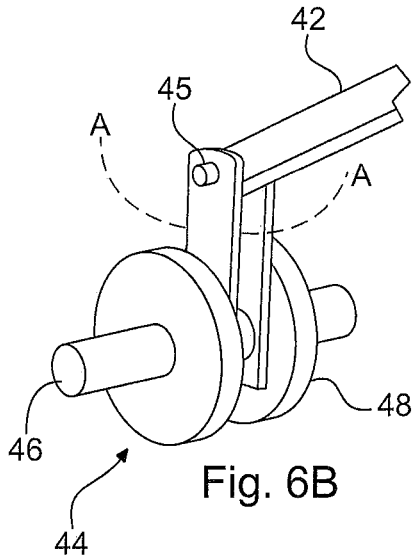
FIG. 6B shows the weight bearing end of FIG. 6A in a different angular position.

As shown, the counter balance assembly 40 may include a reaction arm 42, which extends from the rear portion of the body support assembly 30. The reaction arm 42, being part of counter balance assembly 40, is also pivotable about the frame 20 and may include a weight bearing end 44, which is opposite the body support assembly 30. As illustrated in FIGS. 1-4, the weight bearing end 44 is adapted to receive weights directly thereon. The weight bearing end 44 may, for example, include tubing 46, which can receive weights 48, such as Olympic-style weights. Tubing 46 can be metal tubing, such as two inch round aluminum tubes. Referring now to FIGS. 6A and 6B, the weight bearing end 44 of reaction arm 42 may optionally be pivotable with respect to the reaction arm 42 by, for example, a hinge 45. In this embodiment, the weight bearing end 44 may be angularly adjustable with respect to the reaction arm 42 between a plurality of angular positions from a position extending completely outward from and parallel to reaction arm 42, indicated in FIG. 6A, to any position along broken line A, such as that indicated in FIG. 6B. The hinge 45 of adjustable weight bearing end 44 may be lockable, such that weight bearing end 44 does not pivot about hinge 45 while in use, thereby maintaining a constant angular position with respect to reaction arm 42.

Figure 8:
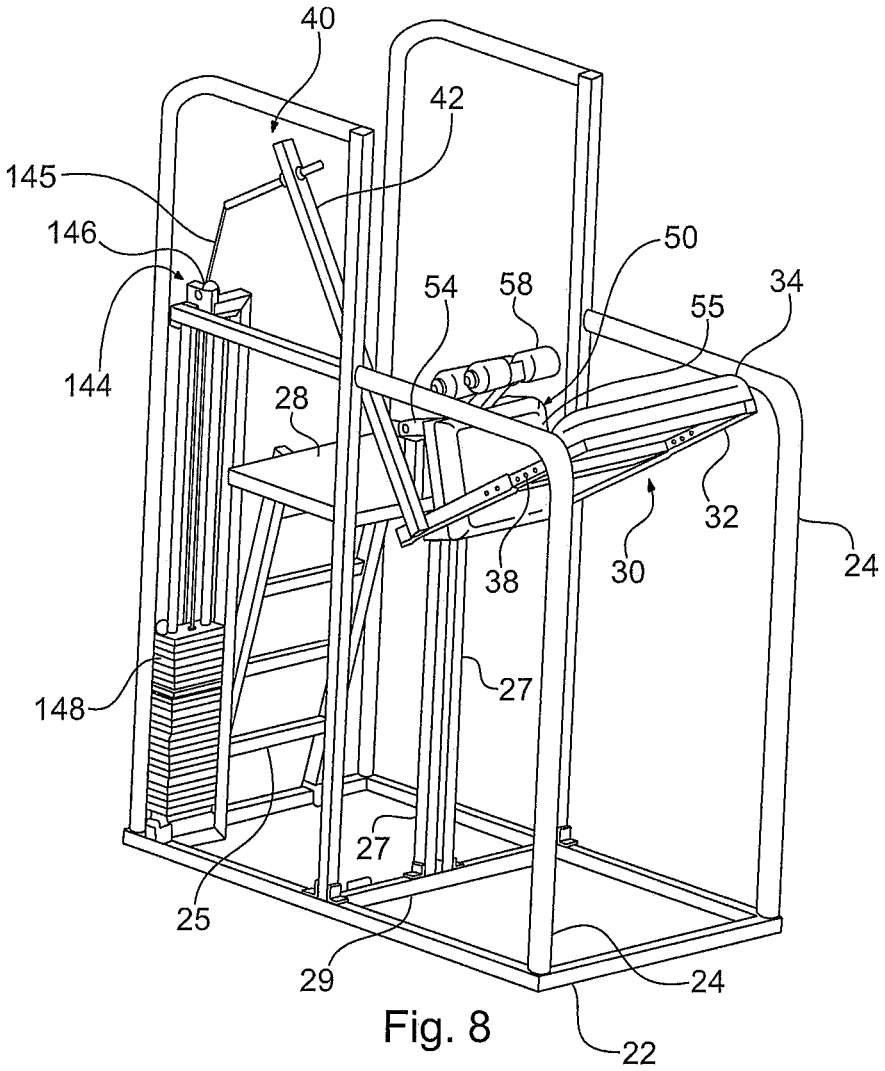
FIG. 8 shows an embodiment of an exercise machine including a cable and pulley system.

Referring now to FIG. 8, the counter balance assembly 40 may alternatively include a cable and pulley system 144. Counter balance assembly 40 includes reaction arm 142, which is connected to a cable 145, which runs over a pulley 146, which is capable of lifting weights from weight stack 148 via a lifting rod. The weights in the weight stack 148 may be a plurality of ten pound plates. In use, when a user is in a downward position, the reaction arm 42 will rotate with the body support assembly 30, thereby pulling weights from weight stack 148 upward with the weight stack 148 counter balancing the user's body weight. In this embodiment, reaction arm 42 may be welded to chest pad frame 32, at an angle as shown, so that chest pad frame 32 and reaction arm 42 are fixedly secured to each other.

Referring now again to FIGS. 1-4, the exercise machine frame 20 may include a base frame 22, two side frames 24, which may extend in an upward direction from the base frame 22, and a knee pad mounting bar 26. The knee pad mounting bar 26 may be connected to an elevated platform 28. As best illustrated in FIGS. 3-5, the frame 20 may include two knee pad mounting bars 26. The knee pad mounting bar 26 may be positioned on a front edge of the platform 28, with the platform being supported by two vertical bars 27 extending downwardly to a base cross bar 29, which attaches to and extends between the base frame 22. The frame may also include a ladder 25 attached to a rear portion of platform 28. Attached to the knee pad mounting bar 26 is a knee pad assembly 50. The knee pad assembly 50 may include a knee pad 55 attached to a knee pad frame 52, which includes rear extensions 54, which are attached to knee pad mounting bar 26. The knee pad assembly 50 may also include adjustable toe and heel pads 58 between which a user's feet are secured during use. A steel bar 56 may extend through extensions 54 and knee pad mounting bar 26, thereby connecting the knee pad frame 52 to knee pad mounting bar 26. The knee pad assembly 50 may be positioned at any angular position, for example, a 75° angle to a horizontal plane, and the knee pad assembly 50 may permanently secured in that angular position. However, alternatively, referring to FIGS. 4 and 5, the knee pad assembly 50 may also be adjustable between a plurality of angular positions between, for example, between 90° and 45° or between 90° and 0° to a horizontal plane, wherein at 0° the knee pad assembly 50 would be parallel to the ground. As shown in FIG. 5, the angle of the knee pad assembly 50 is less than the angle shown in FIG. 4. The knee pad mounting bar 26 may permit the knee pad assembly 50 to be angularly adjustable with respect to the frame 20 and/or platform 28, such that knee pad assembly 50 pivots about mounting bar 26. The knee pad assembly 50 may then be fixedly secured in any of the plurality of angular positions by way of a removable pin and adjustment bar connected under a front part of the knee pad assembly 50. The adjustment bar may be a curved piece of 1 ½ inch metal tubing which is mounted to a bottom portion of the knee pad frame 52 which extends between vertical bars 27, wherein a the pin extends through apertures defined through the adjustment bar and vertical bars 27 to fixedly secure the knee pad assembly 50 in place. Such an arrangement will allow the knee pad assembly 50 to be fixedly secured during use between any number of positions.

Figure 2:
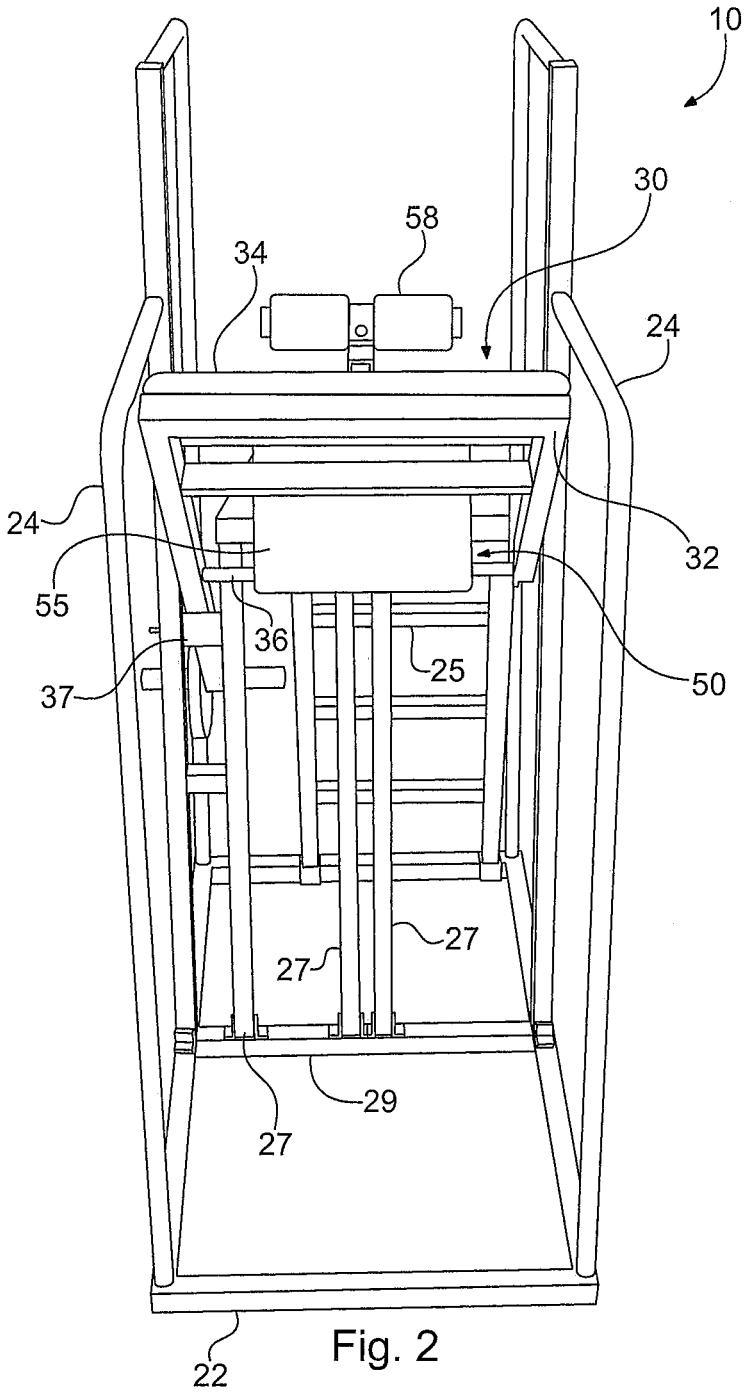
FIG. 2 is a front view of the exercise machine of FIG. 1.
Figure 3:
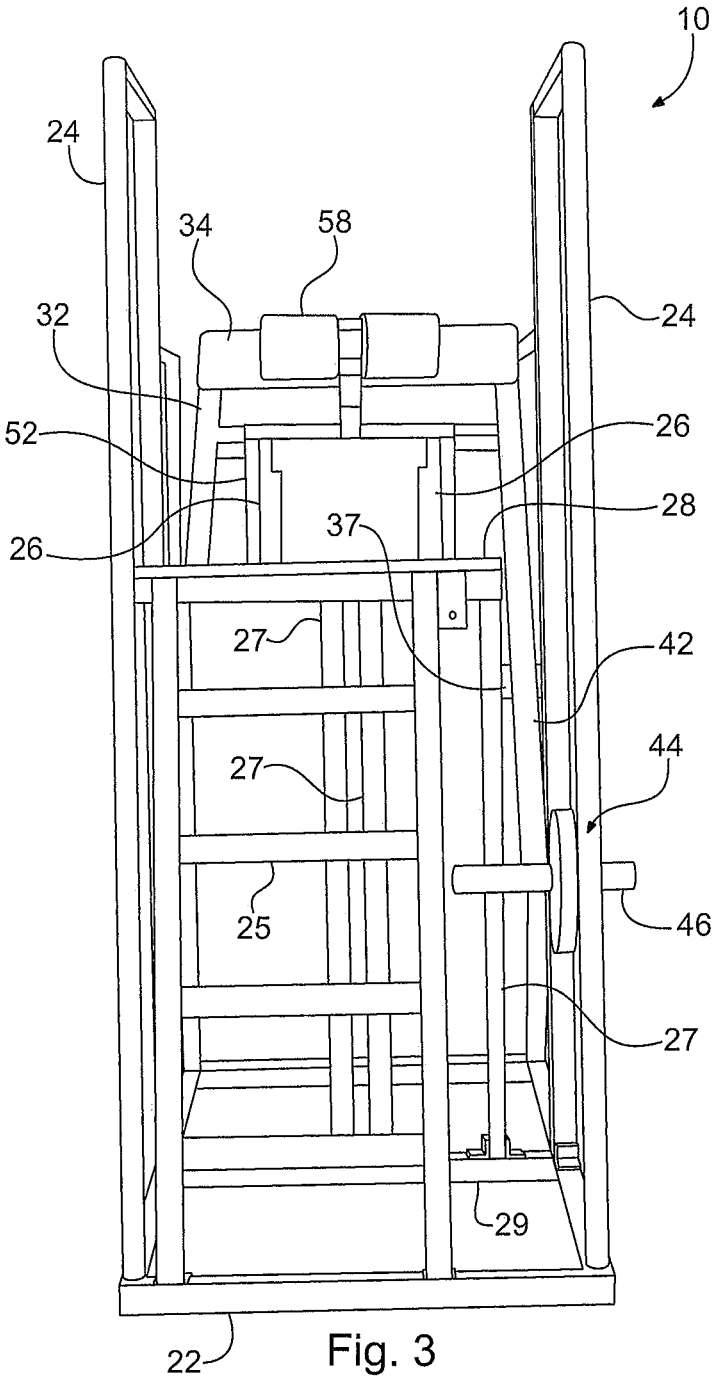
FIG. 3 is a rear view of the exercise machine of FIG. 1.
Figure 4:
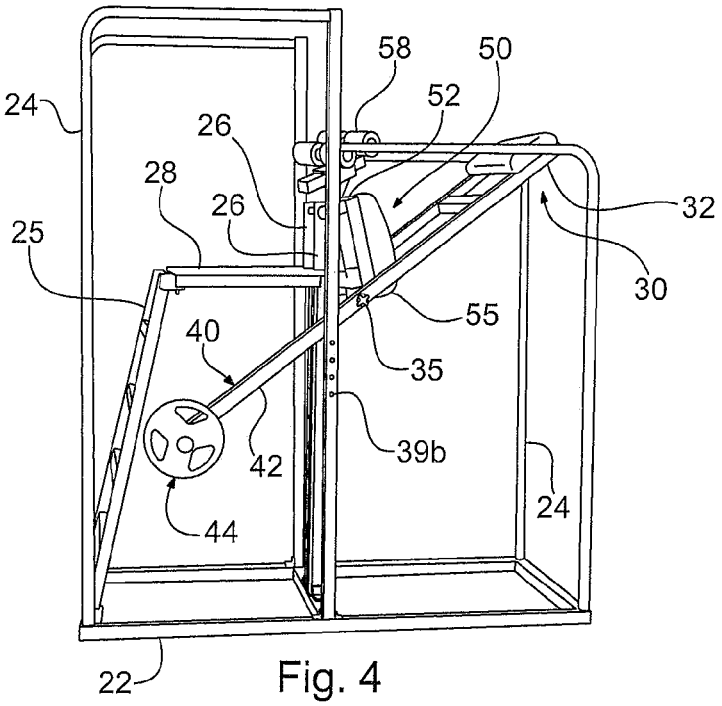
FIG. 4 is a side view of the exercise machine of FIG. 1.
Figure 5:
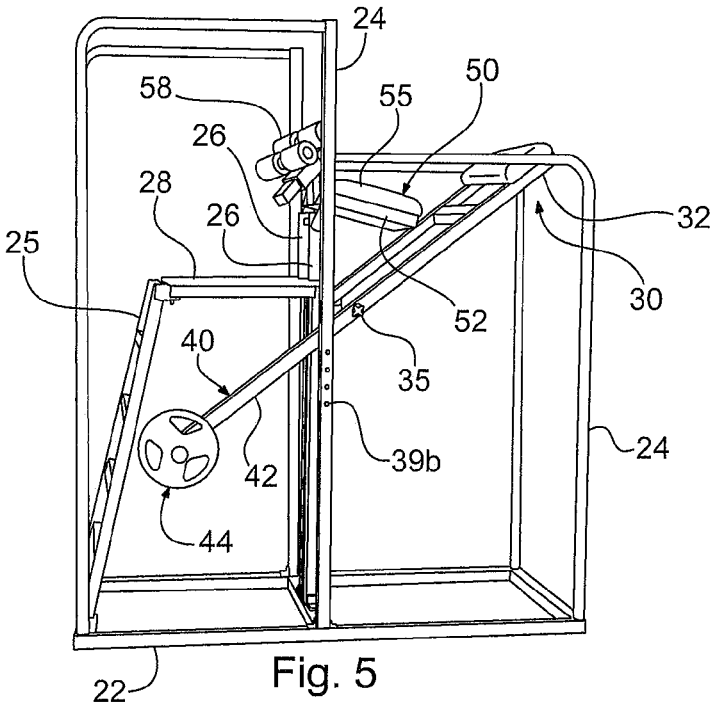
FIG. 5 is an alternative side view of the exercise machine of FIG. 1 showing angular displacement of a knee pad assembly.

The body support assembly 30, shown in FIGS. 1-4, may be, for example, a chest pad assembly having a chest pad frame 32 to which a chest pad 34 is attached. The body support assembly 30 may also include a pivot bar 36, as best shown in FIG. 2, extending through a rear portion of the body support assembly 30 and a bottom portion of knee pad assembly 50, thereby defining an axis of rotation between body support assembly 30 and knee pad assembly 50. The pivot bar 36 may extend through chest pad frame 32 and knee pad frame 52 via cylinder fittings positioned therethrough. The pivot bar 36 allows the body support assembly 30 to pivot about knee pad assembly 50 during operation of exercise machine 10, and corresponds to pivot point 35 on body support assembly 30. As shown, the reaction arm 42 of counter balance assembly 40 may be an extension of chest pad frame 32, which extends from pivot point 35 in a rearward direction.

Also, the chest pad frame 32 may be vertically adjustable to account for variations in a user's height. For example, chest pad frame 32 may be adjustable to various vertical positions indicated by adjustment holes 38 on chest pad frame 32. The chest pad frame 32 may be in slideable engagement with reaction arm 42, such that chest pad frame 32 may be slideably adjusted to any of the positions indicated by adjustment holes 38.

As best shown in FIGS. 1-3, the frame 20 may also include a stopper pad 37 which provides a limit on the amount of angular/pivotable displacement of chest pad assembly 30 and reaction arm 42. For example, in an unused state, reaction arm 42 will pivot to a downward position and chest pad assembly 30 will pivot to an opposite upward position until reaction arm 42 contacts stopper pad 37. In an opposite position, when the exercise machine 10 is being used and the chest pad assembly 30 is in a downward position, with reaction arm 42 in an upward position, the chest pad frame 32 will contact stopper pad 37 at its lowest point, thereby preventing chest pad assembly 30 and reaction 42 from pivoting any further. The stopper pad 37 may be constructed of any material suitable to withstand the repeated contact of reaction arm 42 and chest pad assembly 30. Also, referring to FIGS. 1, 4, and 5, stopper pad 37 may be vertically adjustable via a removable pin or bolt 39*a* and adjustment holes 39*b*, wherein the bolt 39*a* would extend through side frame 24, stopper pad 37, and a vertical bar 27. The lower stopper pad 37 is positioned, the greater the amount of allowed angular displacement of chest pad assembly 30 and reaction arm 42. For example, in an unused state with chest pad assembly 30 in the upward position, chest pad assembly 30 will be closer to vertical, the lower stopper pad 37 is positioned.

Figure 7:
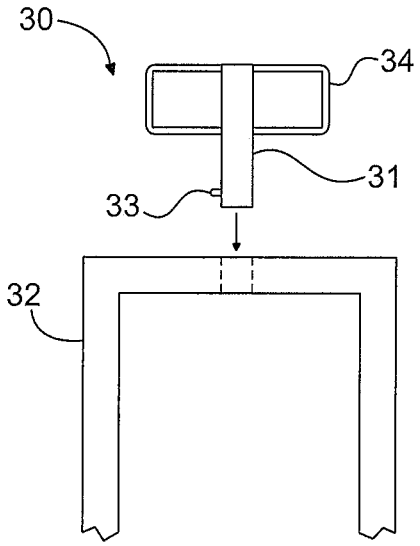
FIG. 7 shows an embodiment of a chest pad assembly.

Referring now to FIG. 7, in an alternative embodiment, the chest pad frame 32 may include an adjustment member 31, which is attached to a rear portion of the chest pad 34. The chest pad frame 32 may optionally be attached to a wood plate, which may, for example, be twenty inches, which, in turn, may be attached to 3/16 or ¼ inch plate aluminum. The adjustment member 31 may then be attached to a rear portion of the plate aluminum. The adjustment member 31 is in slideable engagement with the chest pad frame 32 and may be adjustable to various positions via an adjustable spring loaded pin or plunger pin 33. The chest pad frame 32 may include, for example, two inch square metal tubing whereas adjustment member 31 may include 1% inch square tubing so as to be able to be in slideable engagement with chest pad frame 32.

In general, the construction of exercise machine 10, including frame 20, body support assembly 30, and counter balance assembly 40 may include metal tubing sections, such as two by two or two by four metal tubing. The tubing sections could then be welded and/or bolted together.

Figure 9:
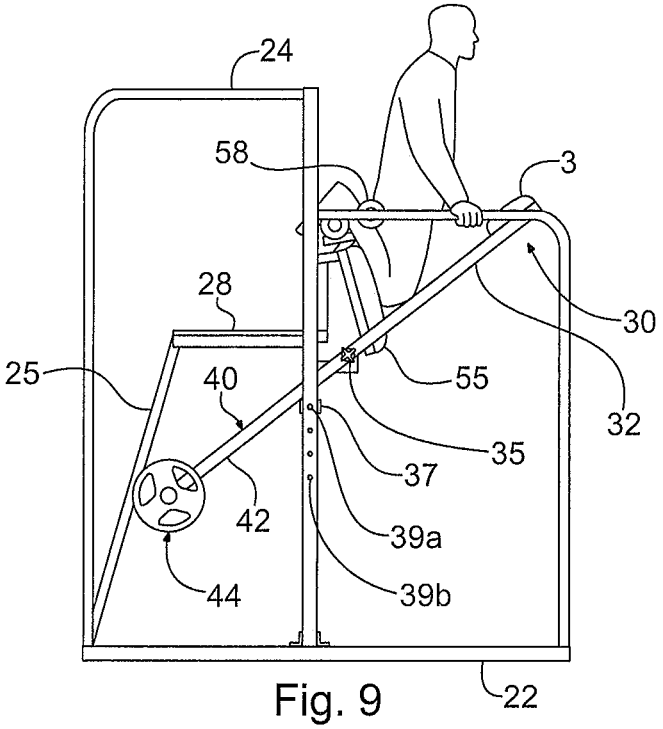
FIG. 9 shows a user positioned on the exercise machine of FIG. 1.
Figure 10:
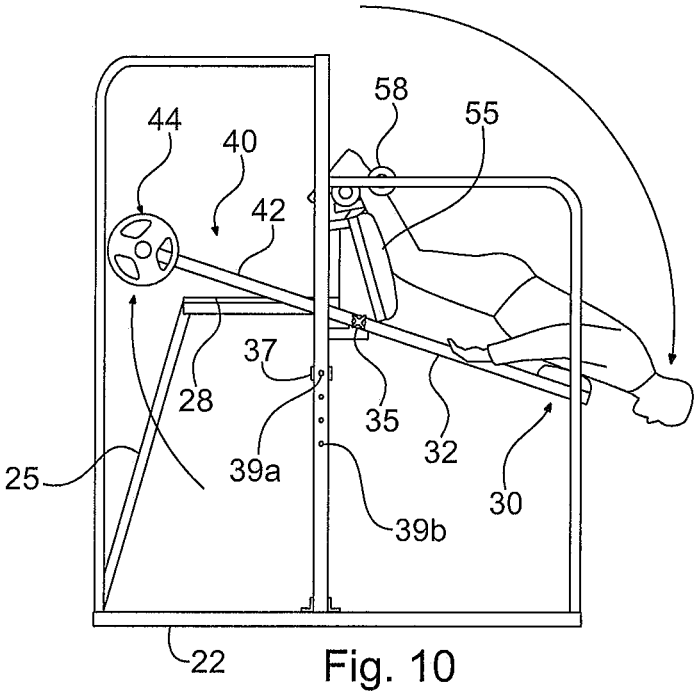
FIG. 10 shows the exercise machine of FIG. 1 in use.

Referring now to FIGS. 9 and 10, in use, a user would secure their feet between toe and heel pad 58 with their knees and shins being positioned against knee pad 55, thereby maintaining the lower legs and knees of the user in a stationary position. The user would then orient his or her body prone against the body support assembly 30. The user's body weight will force the body support assembly 30 to pivot to a downward position with the counter balance assembly 40 pivoting to an opposite upward position, as shown in FIG. 10. The user will then pivot his or her body and body support assembly 30 by pulling the top two-thirds of the body, including the torso, up at the user's knees toward the lower portion of the user's legs positioned against the knee pad assembly 50. The counter balance assembly 40 will offset the user's body weight because with weight bearing end 44 of counter balance assembly 40 being in an upward position, gravity will act to pull the weight downward, thereby assisting the user to complete the motion. Upon completion of the motion, the user's head will be pointed toward the ceiling. This motion will provide tension in the user's hamstring and gluteus muscles, which upon release of that tension, the user's body weight will again force the body support assembly 30 downward and the counter balance assembly 40 upward.

When using the embodiment of weight bearing assembly 44, including a hinge 45, as noted above, the weight bearing assembly 44 is pivotable between a completely outward position wherein the weight bearing assembly 44 is parallel to reaction arm 42 and a plurality of other angular positions along broken line A. In use, the hinge 45 may be locked in any of such plurality of angular positions, or may be unlocked so that weight bearing assembly 44 may pivot about hinge 45 when in use as reaction arm 42 raises and lowers. When the weight bearing assembly 44 is completely outward parallel to reaction arm 42, less weight will be needed to offset the user's body weight. This is because, generally, the longer the reaction arm 42 is in comparison to the rest of the exercise machine 10, the greater the ability of counter balance assembly 40 is to offset the weight of a user when in use.

Referring now to FIGS. 11-15. If a user had difficulty entering the machine using the ladder 25 of FIGS. 1-10, it can be eliminated entirely. To assist the user in getting into the machine more easily, a lifting mechanism 60 can be used. The lifting mechanism comprises a foot plate 61, a foot pad 62, an ankle pad 63, and a lifting assist mechanism 64. To use the lifting mechanism, a user would step onto the foot plate 61 and secure the back of his or her feet against the ankle pad 63. The user would then release the lifting assist mechanism 64, either by pulling a pin or activating a lever 65 which pulls a pin via a cable. An upward force caused by the lifting assist mechanism 64 will assist the user in positioning himself or herself such that he or she is able to use the exercise machine 100. The lifting mechanism is shown in the down position in FIG. 14, where the user steps onto the foot plate 61, and in the up position in FIG. 15, where the user engages lifting assist mechanism 64 and readies the machine for use. The motion of the lifting mechanism 64 could be linear and essentially parallel to the exercise machine frame 101, which means that the lifting mechanism 64 can be slightly angled, such that the movement is not perfectly parallel, for ergonomic reasons; however, it could be positioned at larger angles to the frame 101.

Figure 14:
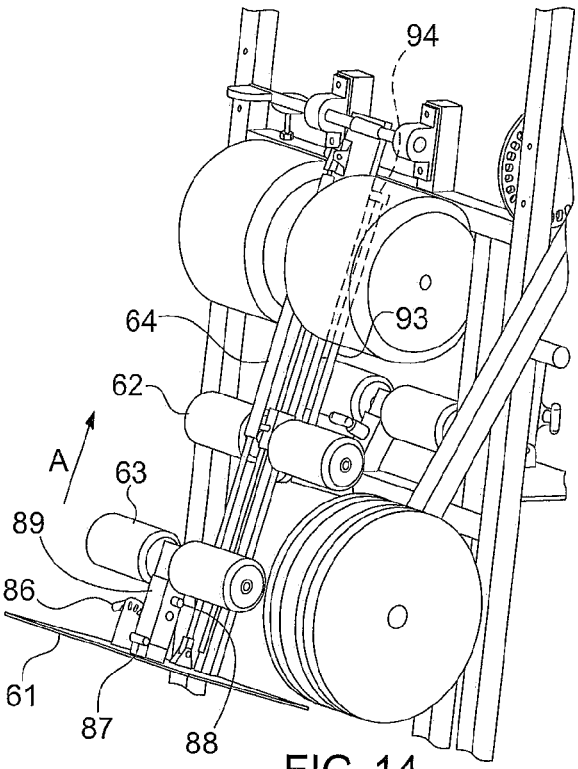
FIG. 14 is a view of the lifting assembly in the down position.
Figure 15:
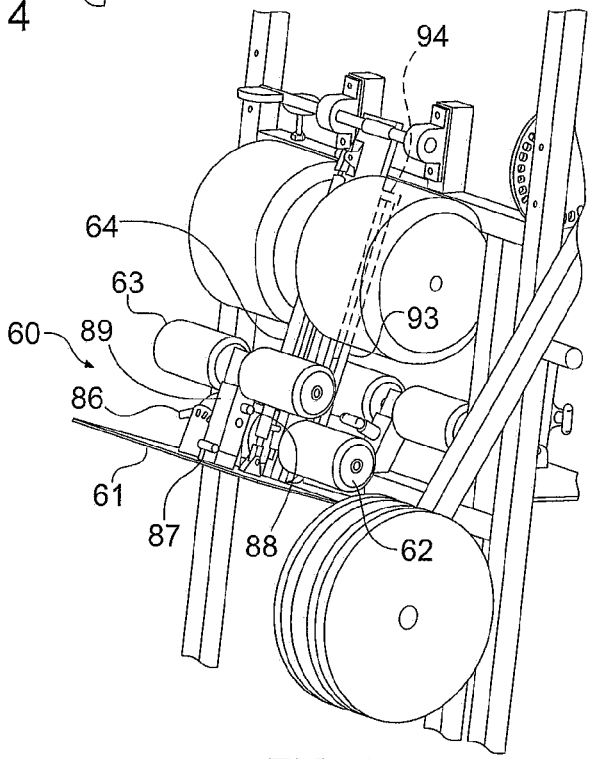
FIG. 15 is a view of the lifting assembly in the up position.

The lifting assist mechanism 64 can be anything which stores mechanical energy and converts that energy into an upward force indicated by arrow A in FIG. 14. Examples include a gas shock or a spring, wherein the user's weight compresses the gas shock or spring and locks into position, and releasing the gas shock or spring assists the user in entering the exercise machine 100. Additionally, the lifting mechanism could be a guide, wherein the user lifts or lowers the footplate by his or her own strength, without the assistance of something like a gas shock or spring. The ladder 25 of FIGS. 1-10 can also be modified such that the top step is similar to the foot plate 61, and the user is able to get into position by stepping onto the topmost step.

Referring to FIG. 14-17, the ankle pad 63 can be rotatable about an ankle pad hinge 87 such that it can be folded flat against the foot plate 61 or positioned perpendicular to the foot plate 61, or at an angle from foot plate 61. The ankle pad 63 is locked in position about the ankle pad by a spring-loaded ankle pad hinge pin 88 which releases into corresponding bores in plate 90. The ankle pad can also be adjusted along a track 89 toward or away from the foot plate 61 by releasing an ankle pad pin 86, moving the ankle pad 63 along the track 89, and securing the ankle pad pin 86 in a bore along the track 89.

Figure 11:
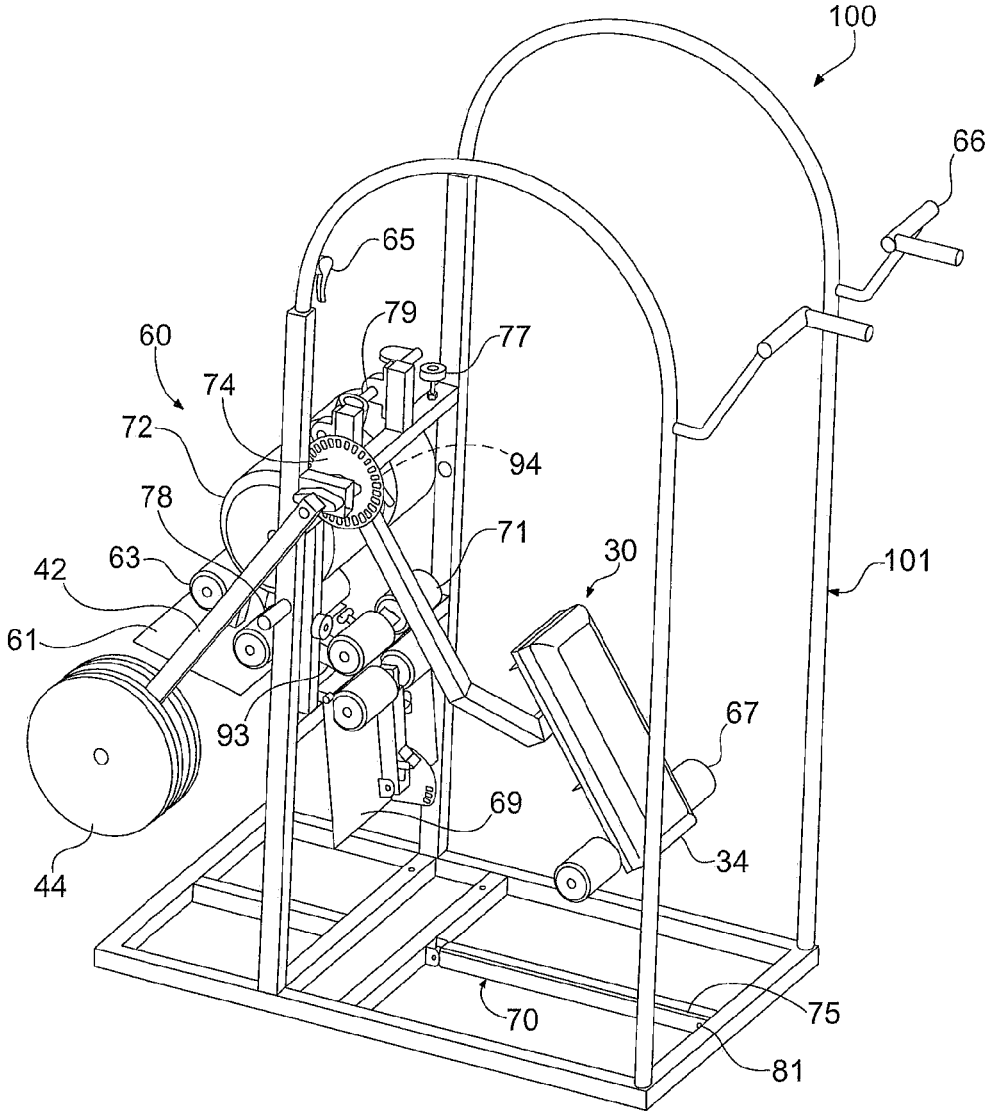
FIG. 11 is a perspective view of an alternative embodiment of an exercise machine.
Figure 16:
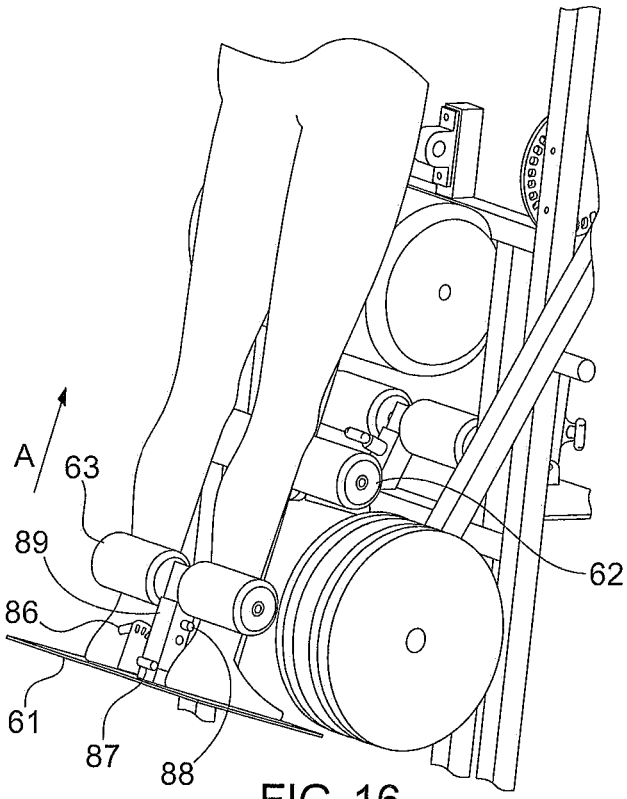
FIG. 16 is a view of the lifting mechanism in the down position with a user.
Figure 17:
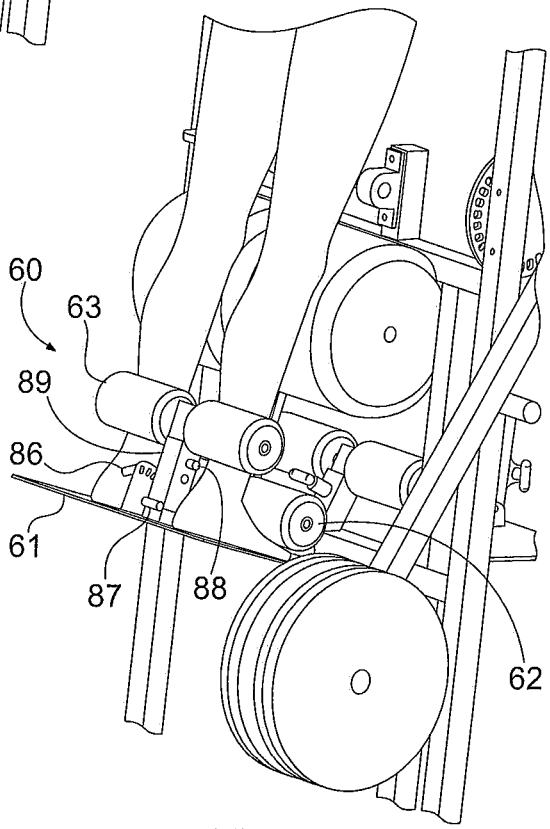
FIG. 17 is a view of the lifting mechanism in the up position with a user.
Figure 18:
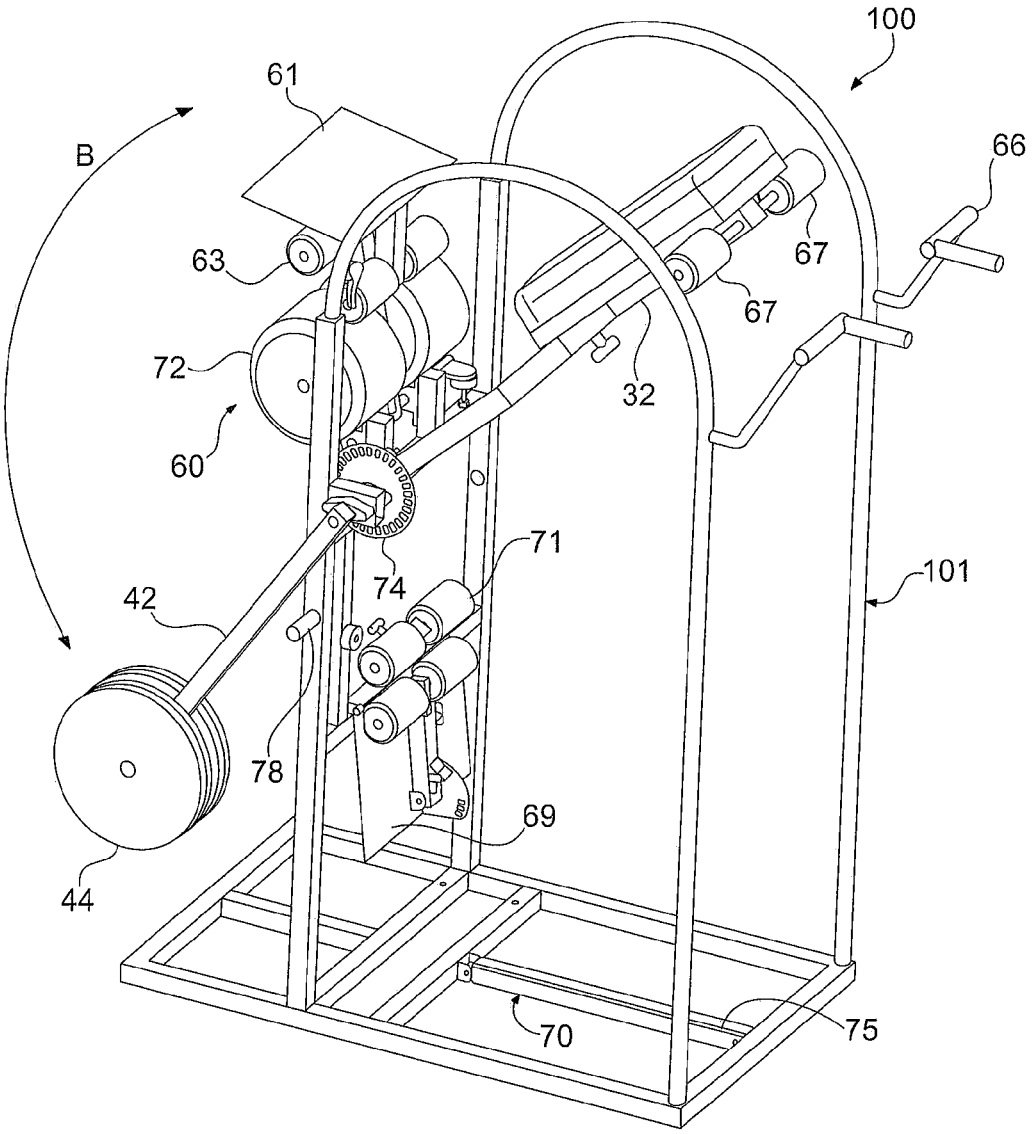
FIG. 18 is a view of the exercise machine in the beginning position.
Figure 19:
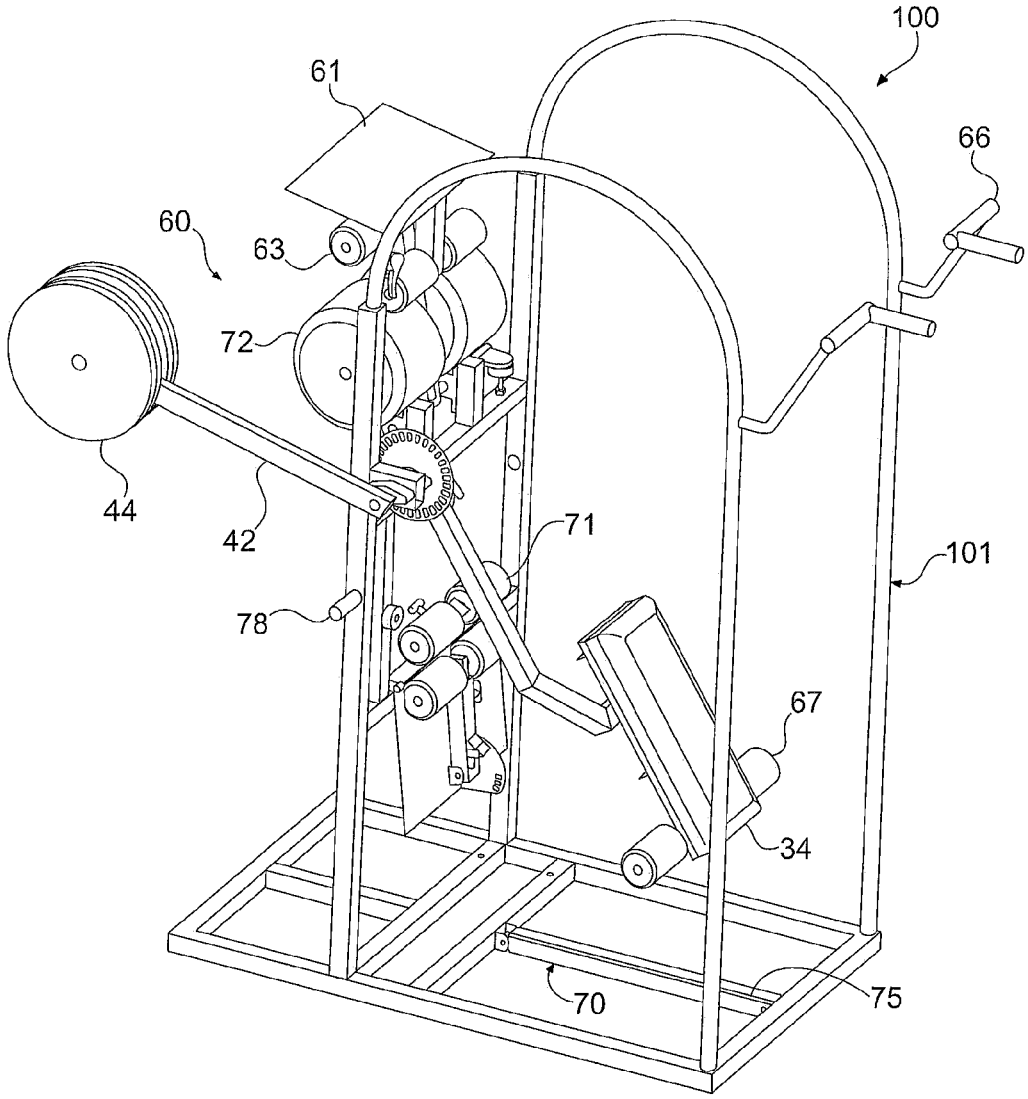
FIG. 19 is a view of the exercise machine in the down position.

FIG. 16 and FIG. 17 illustrate the process wherein a user, engages the lifting mechanism, explained above. Once the user's feet are in place, the user can rotate the lifting mechanism 60 into place to perform the exercise. This is accomplished by swiveling the entire lifting mechanism 60 about the lifting mechanism hinge 79. This is illustrated in FIG. 18 and FIG. 19, wherein the user rotates the lifting mechanism into position from the down position in FIG. 11-17 to the up position in FIG. 18 to begin the exercise. This rotation is indicated by arrow B in FIG. 18. The user then pushes against the chest pad 34 to complete the motion of the exercise, as shown in FIG. 19. Referring to FIG. 11, a gas shock 93 can be used to control the lifting mechanism 60 as it pivots about the lifting mechanism hinge 79. The first end of the gas shock 93 is installed on the stop bar 94 and the second end is installed on the bar supporting the knee pad 72. The gas shock 93 assists the user by providing an upward force such that the user exerts less energy when moving the lifting mechanism 60 into the upward position of FIG. 18, and the upward force also allows the user to return the lifting mechanism to the position of FIG. 11 with less effort and under more control. While a gas shock is preferable, other mechanisms or assists can be used, such as a spring or track.

Figure 12:
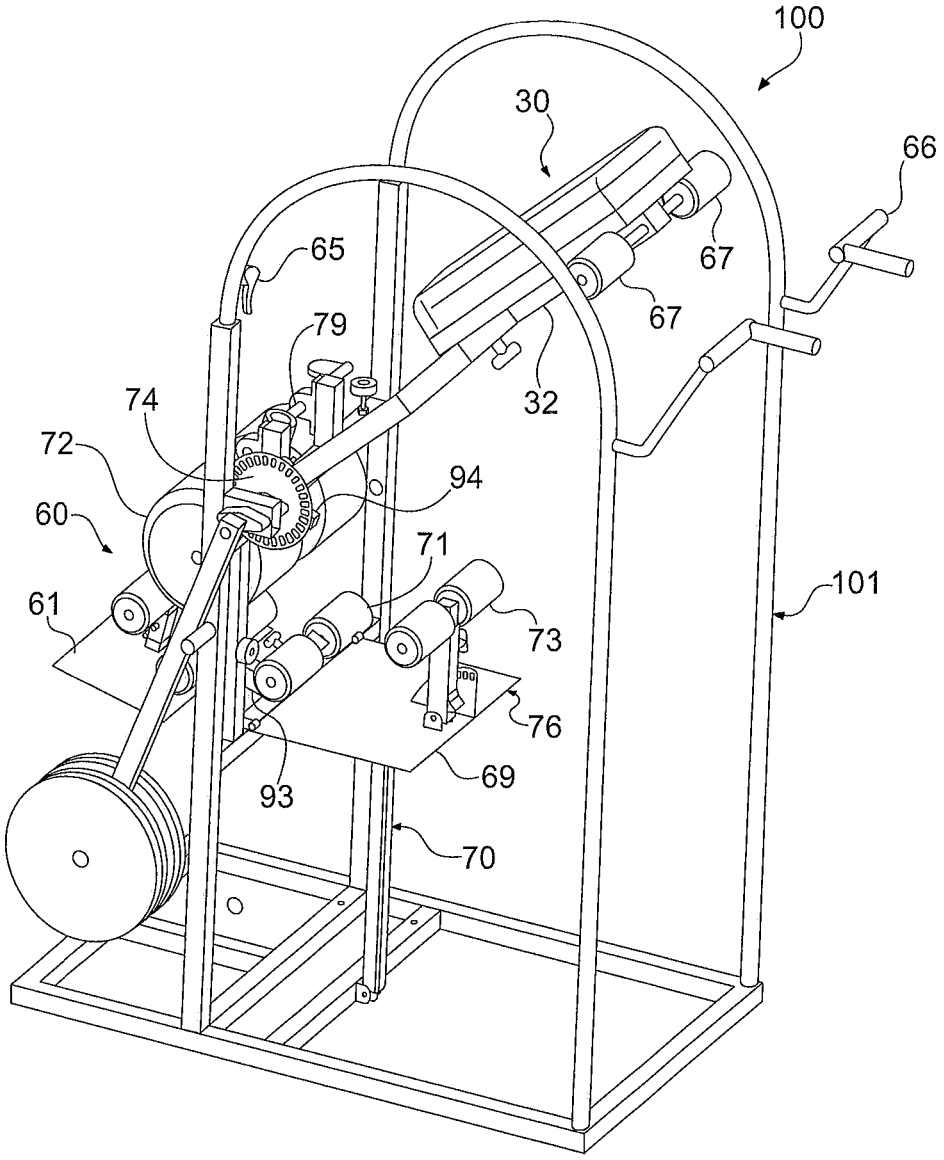
FIG. 12 is an alternative prospective view of the exercise machine of FIG. 11.
Figure 13:
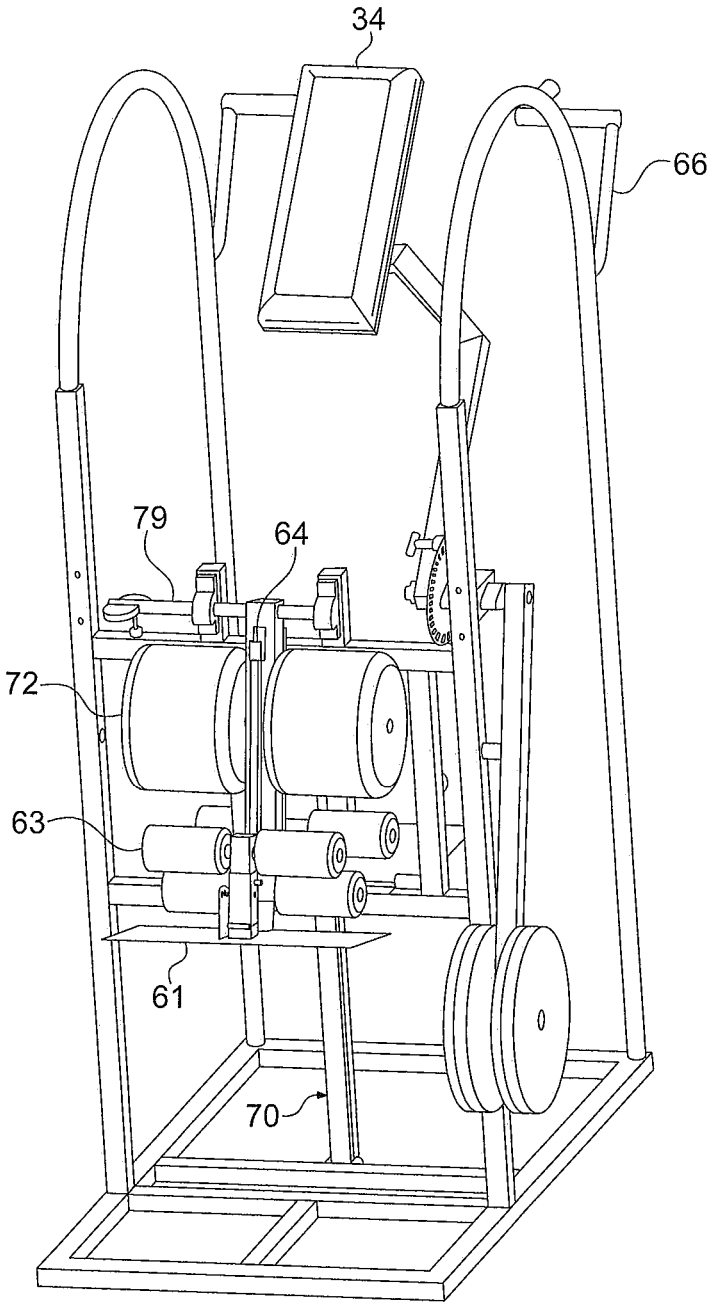
FIG. 13 is a front view of the exercise machine of FIG. 11.

FIG. 11 and FIG. 12 show an alternate design for the frame 20 of FIGS. 1-10 in exercise machine frame 101. Alternative frame designs allow for more or less obstacles to the chest pad frame's range of motion, which can be ideal for adding equipment and exercises to the machine. Additional exercises may require an increased modularity so that components can be quickly moved out of the way and allow an uninhibited range of motion.

In one embodiment, an example of additional alternative exercises is shown. This can be seen by FIG. 12 and FIG. 13, where the standing plate 69 and support member 70 can both be folded down to allow the body assembly to travel all the way down. The standing plate 69 supports a user while standing and the user secures his or her feet by placing his or her feet under the toe pad 71. The use of an adjustment wheel 74, rather than a hinge, on the chest pad frame 32 allows the user to alter the angle between the chest pad frame 32 and the weight bearing end 44.

Figure 20:
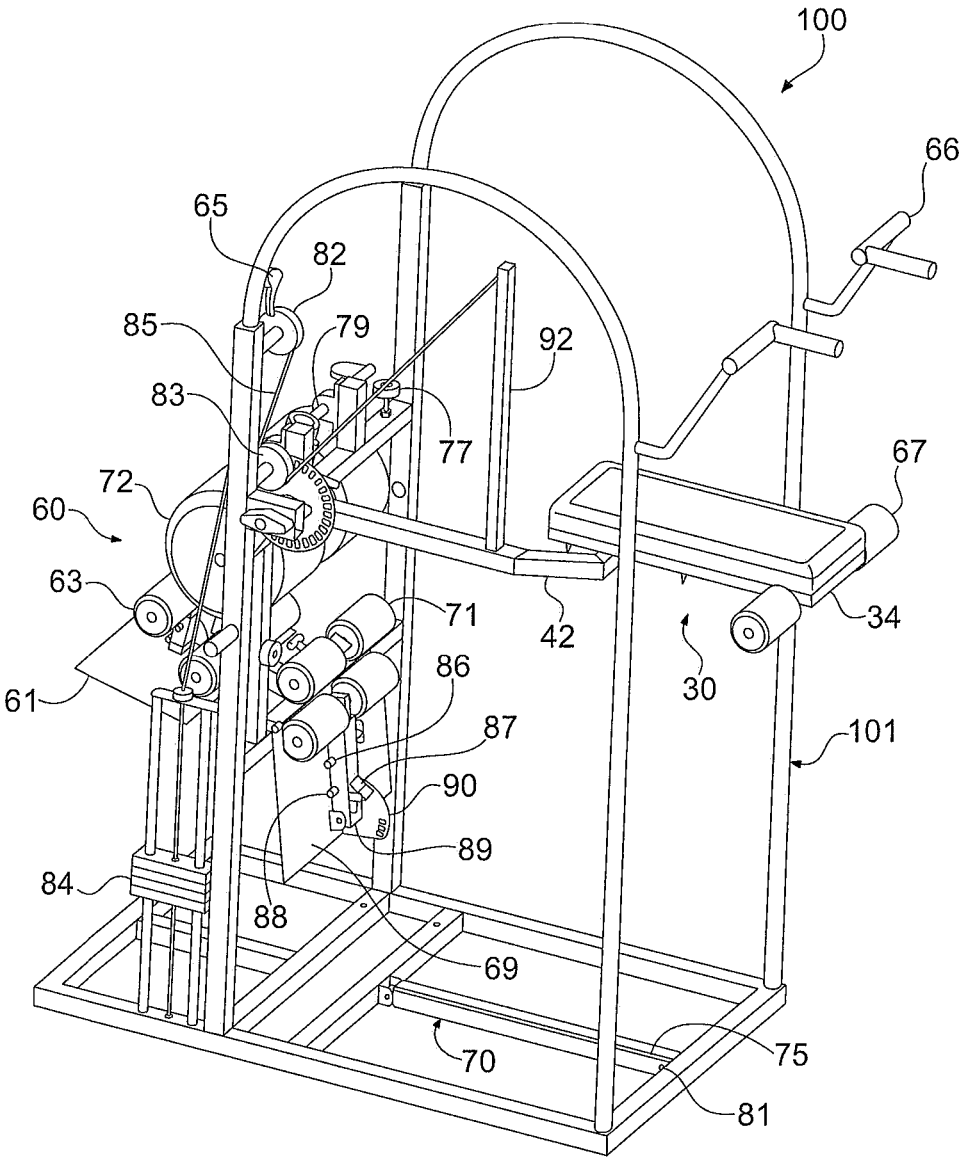
FIG. 20 is a perspective view of the exercise machine with a pulley system.

Though FIG. 11 and FIG. 12 portray the weight bearing end 44 as being capable of receiving weights, a weight and pulley system, as shown in FIG. 20, can also be used in this embodiment. Because of the increased range of motion of this embodiment, more than one pulley can be used, in an alternating manner, to prevent the cable from going slack. The weight stack 84, will connect via a cable 85 to a cable arm 92 connected to the reaction arm 42 by passing over a first pulley 82 and under a second pulley 83. The second pulley 83 is located in close proximity to the adjustment wheel 74 to prevent the cable 85 from becoming slack as the reaction arm 42 is moved higher or lower along the adjustment wheel 74.

Because of the customizability of the exercise machine, various components may be added or modified which allow the user to perform different exercises. One such example is the addition of pull-up bars 66. When the chest pad 34 is lowered to a point below the pull-up bars 66, the user can rest his or her knees on the chest pad 34 and use the weight-bearing end 44 to assist in the pull-up exercise. The weight of the weight-bearing end 44 will allow the user to offset his or her body weight and allow him or her to complete a pull-up with less difficulty. For example, if the user weighs 200 pounds, and places 50 pounds on the weight-bearing end 44, the user will only need to lift 150 pounds of his or her own body weight to complete the pull-up. Though not necessary, if the chest pad 34 is vertically adjustable, it will allow the user to position himself or herself anywhere along the pull-up bars 66 and allow him or her to still put his or her knees on the chest pad 34.

The exercise machine 100 can also be manipulated to allow the user to perform hamstring curls. The addition of hamstring pads 67 to the chest pad frame 32 allows the user to perform hamstring curls. To set up the machine for hamstring curls, the user adjusts the position of the chest pad frame 32 by altering the adjustment wheel 68 such that the chest pad frame 32 is in its bottommost position and is essentially perpendicular to the ground. The user would then stand such that the hamstring pad 67 was behind the user's ankle or calf, and using his or her hamstring muscle, the user lifts the chest pad frame 32 away from the floor.

The exercise machine 100 can also be altered to perform quadriceps exercises via the use of a quadriceps assembly 76. This alteration can be seen in FIG. 11 and FIG. 12, where FIG. 12 is the machine in its quadriceps state. This is accomplished by moving the chest pad frame 32 into the upright position and lifting the standing plate 69 into the upright position. To support the user's weight, a support member 70 folds up and braces the standing plate 69. The standing plate will have a pin or spring-loaded pin which mates to a bore 81 in the support member 70. To make assembly quicker and easier, the support member 70 can have a beveled corner 75 wherein the beveled corner presses against the spring-loaded pin and the pin remains compressed until the support member 70 is in its final position and the bore hole aligns with the spring-loaded pin. Once the standing plate 69 is assembled in its upright position, the user places the front of his or her feet under the toe pad 71 and stands such that his or her back is resting on the chest pad 34, his or her knees are resting against the knee pad 72, and the back of his or her legs are resting against the calf pad 73. The user then pushes against the chest pad 34 to perform the exercise.

Another possible exercise a user can perform is a gluteus muscle exercise. In this exercise, the user stands under the pull-up bars 66 and positions the body support assembly 30 such that the hamstring pad 67 is located underneath the user's knee when the user's leg is bent at a 90° angle. The user then straightens his or her leg by exerting a downward force onto the hamstring pad 67, thereby lifting the weight bearing end 44 from a down to an up position for resistance. The user would then lift his or her leg until the body support assembly 30 is in its original position.

The user could also perform a gluteus exercise with the hamstring pad 67 located on his or her thigh. The user would again position his or her knee at a 90° angle and lower his or her leg until the leg is straight, or keep the knee bent at 90° and move his or her leg down and to the rear, then exert an upward force upon the hamstring pad 67 until the body support assembly 30 is in its beginning position.

For safety and ease of use, several stops can be incorporated to prevent unwanted movement. A stop bar 94 is located in front of the lifting mechanism 60 such that when a user is done with his or her leg curl exercise and rotates the lifting mechanism 60 about the lifting mechanism hinge 79 in the down position, the stop bar 94 stops the motion of the lifting mechanism 60. The movement stop 77 prevents the user from falling too far forward and the chest pad frame 32 from damaging the quadriceps assembly 76. Likewise, the weight stop 78 prevents the weights from swinging like a pendulum and hurting a user. The weight stop 78 can be removable to allow the user to perform a broader range of motion when performing the leg curl exercise.

While specific embodiments of the above-described exercise machine have been described in detail, it will be appreciated by those skilled in the art that various modifications and alternatives to those details could be developed in light of the overall teachings of the present disclosure. The presently preferred embodiments described herein are meant to be illustrative only and not limiting as to the scope of the invention, which is to be given the full breadth of the appended claims and any and all equivalents thereof.

The invention claimed is:

1. An exercise machine comprising:

a frame;

a body support assembly in pivotable engagement with the frame;

a lifting mechanism engaged with the frame and adapted to lift a user into a prone position against the body support assembly; and a counter balance assembly connected to the body support assembly and comprising a reaction arm extending from a rear portion of the body support assembly and pivotable about the frame, the reaction arm including a weight bearing end opposite the body support assembly, wherein, in operation, the body support assembly is pivotable from a downward position to a top position, and the counter balance assembly partially offsets a body weight of the user as the body support assembly is pivoted from the downward position to the top position, and wherein, when the body support assembly is in the downward position, the weight bearing end is in a raised position providing a counter balance to the user's body weight.

2. The exercise machine of claim 1, wherein the lifting mechanism is rotatable about a lifting mechanism hinge and adapted to lift and rotate a user into a prone position against the body support assembly.

3. The exercise machine of claim 1, wherein the lifting mechanism is essentially parallel with the frame.

4. The exercise machine of claim 1, wherein the lifting mechanism comprises a foot plate with an ankle pad connected via a lifting assist mechanism to a foot pad, and wherein the lifting assist mechanism provides an upward force and brings the foot plate and foot pad together.

5. The exercise machine of claim 4, wherein the lifting assist mechanism is a gas shock.

6. The exercise machine of claim 1, further comprising a standing plate in pivotable engagement with the frame and a support member in pivotable engagement with the frame, wherein the support member pivots upward to support the weight of the standing plate.

7. The exercise machine of claim 1, wherein the weight bearing end is adapted to receive weights directly thereon.

8. The exercise machine of claim 1, wherein the counter balance assembly further comprises a cable and pulley system having a first pulley, a second pulley, a weight stack, and a cable running from the weight stack over the first pulley, under the second pulley, and to a cable arm connected to the body support assembly, wherein, when the body support assembly is in the top position, the weight stack is in a lowered position, and, wherein when the body support assembly is in the downward position, the reaction arm lifts the weight stack to a raised position providing a counter balance to the user's body weight.

9. The exercise machine of claim 1, wherein the weight bearing end is pivotally attached to the reaction arm via an adjustment wheel, wherein the weight bearing end is angularly adjustable with respect to the reaction arm between a plurality of angular positions.

10. The exercise machine of claim 1, wherein the body support assembly comprises a chest pad assembly.

11. The exercise machine of claim 10, wherein the chest pad assembly comprises a chest pad and a chest pad frame wherein the chest pad frame is adjustable with respect to the chest pad, such that the chest pad is in slideable engagement with the chest pad frame and can be positioned at varying distances from the chest pad frame.

12. The exercise machine of claim 11, wherein the chest pad assembly further comprises at least one hamstring pad wherein the chest pad assembly is adapted to allow the user to perform hamstring exercises.

13. A method of performing an exercise, comprising the steps of:

positioning a user's feet on a foot plate and securing the user's ankle against an ankle pad;

rotating the foot plate, toe pad, and ankle pad about a lifting mechanism hinge of a lifting mechanism engaged with a frame to lift a user into a prone position against a body support assembly;

pivoting the body support assembly from a downward position to a top position; and counter balancing the user's body weight via a weight bearing end of a counter balance assembly reaction arm pivotable about the frame, the weight bearing end extending from a rear portion of and being opposite the body support assembly, such that it is in a raised position when the body support assembly is in the downward position at least partially offsetting a body weight of the user as the body support assembly is pivoted from the downward position to the top position.

14. A method of performing an exercise according to claim 13, further comprising the steps of:

orienting a user's body prone against a body support assembly; and moving the user's body from a downward position to a top position by pivoting the body support assembly from a downward position to a top position about the exercise machine frame via the user's knees.

15. The method of claim 14, further comprising, after the step of moving the user's body from a downward position to a top position, moving the user's body from the top position to the downward position by pivoting the body support assembly from the top position to the downward position about the exercise machine frame via the user's knees.

16. The method of claim 14, wherein the step of counter balancing the user's body comprises the step of offsetting the user's body weight by adding weight resistance to a weight bearing end of a reaction arm extending away from the body support assembly.

17. The method of claim 13, further comprising the steps of releasing a lever and moving the foot plate toward the toe pad.

* * * * *